US007644593B2

(12) United States Patent
Duraisamy

(10) Patent No.: US 7,644,593 B2
(45) Date of Patent: Jan. 12, 2010

(54) $CO_2$ REFRIGERATION CIRCUIT WITH SUB-COOLING OF THE LIQUID REFRIGERANT AGAINST THE RECEIVER FLASH GAS AND METHOD FOR OPERATING THE SAME

(75) Inventor: Suresh Duraisamy, Liverpool, NY (US)

(73) Assignee: Carrier Corporation, Farmington, CT (US)

( * ) Notice: Subject to any disclaimer, the term of this patent is extended or adjusted under 35 U.S.C. 154(b) by 112 days.

(21) Appl. No.: 11/659,925

(22) PCT Filed: Feb. 18, 2005

(86) PCT No.: PCT/US2005/005413

§ 371 (c)(1),
(2), (4) Date: Oct. 12, 2007

(87) PCT Pub. No.: WO2006/022829

PCT Pub. Date: Mar. 2, 2006

(65) Prior Publication Data

US 2008/0078203 A1 Apr. 3, 2008

(30) Foreign Application Priority Data

Aug. 9, 2004 (DE) ..... 10 2004 038 640

(51) Int. Cl.
*F25B 1/10* (2006.01)

(52) U.S. Cl. ..... 62/510; 62/335; 62/509

(58) Field of Classification Search ..... 62/335, 62/498, 509, 510, 511, 513
See application file for complete search history.

(56) References Cited

U.S. PATENT DOCUMENTS 4,779,427 A * 10/1988 Rowley et al. ..... 62/467
6,981,377 B2 * 1/2006 Vaynberg et al. ..... 60/641.8

* cited by examiner

*Primary Examiner*—Melvin Jones
(74) *Attorney, Agent, or Firm*—Bachman & LaPointe, P.C.

(57) ABSTRACT

$CO_2$ refrigeration circuit (2) for circulating a refrigerant in a predetermined flow direction, comprising in flow direction a heat-rejecting heat exchanger (4), a receiver (10) having a liquid portion (12) and a flash gas portion (14), and subsequent to the receiver (10) a medium temperature loop (20) and a low temperature loop (24), wherein the medium and low temperature loops (24) each comprise in flow direction an expansion device (26, 28), an evaporator (30, 32) and a compressor (46, 38), the refrigeration circuit (2) further comprising a liquid line (16) connecting the liquid portion (12) of the receiver (10) with at least one of the medium and low temperature loops (20, 24) and having an internal heat exchanger (54), and a flash gas line (50) connecting the flash gas portion (14) of the receiver (10) via the internal heat exchanger (54) with the inlet of the low temperature compressor (46), wherein the internal heat exchanger (54) transfers in use heat from the liquid flowing through the liquid line (16) to the flash gas flowing through the flash gas line (50).

14 Claims, 1 Drawing Sheet

Figure 1:
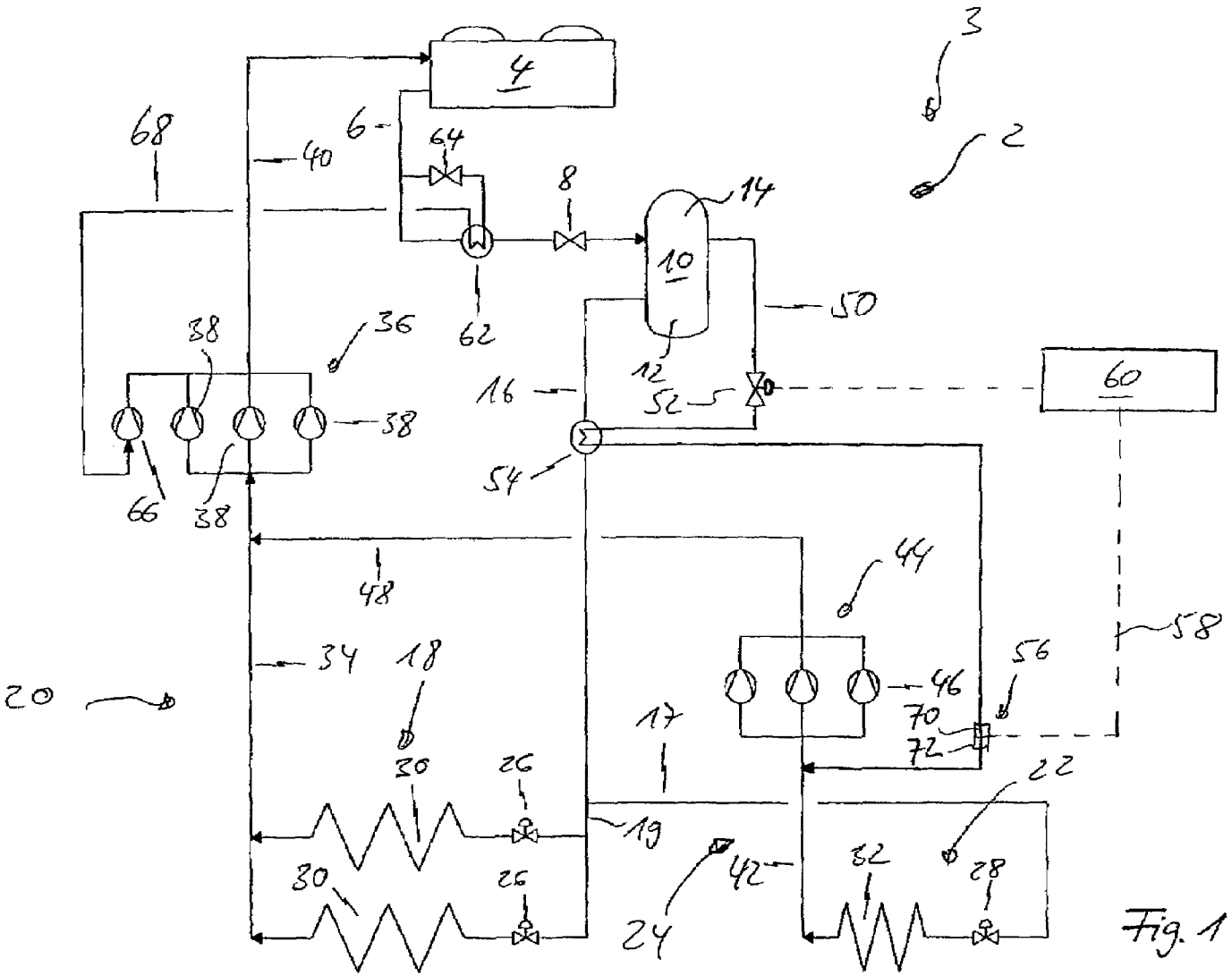

$CO_2$ REFRIGERATION CIRCUIT WITH SUB-COOLING OF THE LIQUID REFRIGERANT AGAINST THE RECEIVER FLASH GAS AND METHOD FOR OPERATING THE SAME

CROSS-REFERENCE TO RELATED APPLICATION

This is the 35 USC 371 National Phase of International Application PCT/US2005/005413, filed Feb. 18, 2005.

The present invention relates to a $CO_2$ refrigeration circuit for circulating a $CO_2$ refrigerant in a predetermined flow direction, comprising in flow direction a heat-rejecting heat exchanger, a receiver having a liquid portion and a flash gas portion, and subsequent to the receiver a medium temperature loop and a low temperature loop, wherein the medium and low temperature loops each comprise in flow direction an expansion device, an evaporator and a compressor. The refrigeration circuit further comprising a liquid line connecting the liquid portion of the receiver with at least one of the medium and low temperature loops. The present invention also relates to a method for operating a refrigeration circuit of this kind.

With a $CO_2$ refrigeration circuit of this type flash gas will be generated in the receiver and there is the need to draw the flash gas from the receiver in order to maintain continuous operation of the $CO_2$ refrigeration circuit. It has been suggested to return the flash gas to the inlet or suction of the medium temperature compressor. The flash gas is, however, generally at a higher pressure than the suction gas in the suction line leading to the compressor, and the necessary expansion of the flash gas to such lower pressure results in undesirable losses for the refrigeration circuit.

Thus, it is an object to handle the flash gas as collected in the receiver and improve the efficiency of the refrigeration circuit as compared to the mere expanding of the flash gas towards the inlet of the medium temperature compressor.

An earlier, but on the filing date of the present application unpublished application DE 10 2004 038 640.4 of the subsidiary Linde Kältetechnik GmbH & Co. KG of the applicant, the disclosure of which is incorporated as a whole into the present application, suggests to flow the flash gas via an internal heat exchanger in heat exchange relationship with the liquid refrigerant exiting from the receiver and to the return line of the low temperature loop leading to the compressor of the medium temperature loop.

The present invention is directed to an alternative solution for the above mentioned problem.

In accordance with an embodiment of the present invention, this problem is solved by having an internal heat exchanger within the liquid line and a flash gas line connecting the flash gas portion of the receiver through the internal heat exchanger with the inlet of the low temperature compressor, wherein the internal heat exchanger transfers in use heat from the liquid flowing through the liquid line to the flash gas flowing through the flash gas line. The transfer of heat results in a sub-cooling of the liquid in the liquid line and a super-heating of the flash gas. The sub-cooling of the liquid results in an improvement of the refrigeration capacity of the liquid refrigerant. At the same time the super-heating of the flash gas ensures that the flash gas is fully dry and superheated before entering into the low temperature compressor. The higher temperature difference and the higher pressure difference of such system as compared to the solution of DE 10 2004 038 640.4 results in a larger improvement of the refrigeration capacity.

In accordance with an embodiment of the present invention a flash gas valve is located in the flash gas line. Instead of the flash gas valve any other expansion device can be provided.

The flash gas valve allows for enabling and disabling the flow of the flash gas to the internal heat exchanger and finally to the compressor. The generation of flash gas is highly dependent on the environmental conditions, particularly if the heat-rejecting heat exchanger operates against ambient air, and it has been suggested to adjust the refrigeration circuit between "winter mode" and "summer mode". If, for example in the winter mode, the generation of the flash gas is relatively low, it might be more effective to close the flash gas valve or to adjust it to a smaller amount of flash gas flow, in case an adjustable flash gas valve is provided for.

In accordance with a preferred embodiment of the present invention the flash gas valve is a control valve. The control valve allows for an automatic control thereof by means of a control, for example centrally switching over between "summer mode" and "winter mode" by means of the control.

In accordance with a preferred embodiment of the present invention the $CO_2$ refrigeration circuit further comprises a monitoring device in the flash gas line which is adapted for monitoring the condition, i.e. the superheating, of the flash gas. This allows for adjustment of operational parameters in case that a 2-phase flash gas is detected by the monitoring device. The monitoring device can include a pressure sensor and/or a temperature sensor. The combination of pressure sensor and temperature sensor is a particularly simple method for determining the "quality" of the flash gas. Other sensors can also be used. It is preferred to connect a control to the monitoring device, i.e. to provide the monitoring signals to a control, and to connect the control to the control valve for regulating the control valve based on the condition of the flash gas. Accordingly, the flow of flash gas through the internal heat exchanger can be controlled on the basis of the flash gas quality. Thus, if there is no superheating in the flash gas, i.e. if a 2-phase flash gas is present in the flash gas line, the flow of the flash gas can be reduced in order to increase the heat transfer from the liquid refrigerant to the flash gas. It is to be noted that the idea of providing a control valve and controlling the control valve dependent on the flash gas quality is regarded to be inventive on its own and particularly without or with only part of the features as claimed in the independent claims.

The $CO_2$ refrigeration circuit may comprise an intermediate expansion device between the heat-rejecting heat exchanger and the receiver. The intermediate expansion device can reduce the high pressure with the heat-rejecting heat exchanger which can be as high as 100 to 120 bar to a medium pressure of approximately 30 to 40 bar and preferably approximately 36 bar. It is possible to supply the refrigerant with the medium pressure to the refrigeration consumer(s) comprising the consumer expansion device and consumer evaporator. While the compressor, the heat-rejecting heat exchanger and the receiver are generally located next to each other in or next to a separate machine room, the lines to the refrigeration consumers can have a substantial length. By having a reduced pressure in such lines only, the costs for the lines and the expenses for sealing the respective consumers can substantially be reduced.

In accordance with an embodiment of the present invention the outlet of the low temperature compressor is connected with the inlet of the medium temperature compressor. The terms "low temperature loop" and "medium temperature loop" generally refer to closed loops each. Parts of the loops can, however, coincide with a joint loop portion. Thus, in an embodiment of the invention the medium temperature compressor can form the second stage compressor for the low temperature loop. Other components like heat-rejecting heat exchanger and/or intermediate expansion device and/or receiver can also be components of the joint portions of the loops. Alternatively, it is possible to separately provide a single low temperature compressor or a plurality of low temperature compressor stages for the low temperature loop.

Another embodiment of the invention relates to a $CO_2$ refrigeration apparatus comprising a $CO_2$ refrigeration circuit in accordance with an embodiment of the present invention. The refrigeration apparatus can be a refrigeration system for a supermarket, an industrial refrigeration system, etc. In case of a supermarket refrigeration system, the medium temperature refrigeration consumer(s) can be display cabinets and the like for example for milk product, meat, vegetables and fruits with a refrigeration level of less than 10° C. down to around 0° C. The low temperature refrigeration consumer(s) can be freezers with a refrigeration level of −20° C. and lower.

Another embodiment of the present invention relates to a method for operating a $CO_2$ refrigeration circuit for circulating a refrigerant in a predetermined flow direction, the $CO_2$ refrigeration circuit comprising in flow direction a heat-rejecting heat exchanger, a receiver having a liquid portion and a flash gas portion, and subsequent to the receiver a medium temperature loop and a low temperature loop, wherein the medium and low temperature loops each comprise in flow direction an expansion device, an evaporator and a compressor, the refrigeration circuit further comprising a liquid line connecting the liquid portion of the receiver with at least one of the medium and low temperature loops, wherein the method comprises the following steps:

(a) tapping flash gas from the flash gas portion of the receiver;

(b) flowing the flash gas and flowing the liquid in the liquid line in heat exchange relationship to effect a heat transfer from the liquid to the flash gas;

(c) returning the flash gas into the low temperature loop at a pressure level of approximately that of the inlet of the low temperature compressor.

In respect to step (c) it is possible to return the flash gas directly into the inlet of the low temperature compressor or into the low temperature suction line leading towards the low temperature compressor, etc.

In accordance with an embodiment of the present invention the method further includes the step of adjusting the amount of flash gas which is tapped from the receiver, i.e. the flash gas flow, in accordance with the operational condition of the $CO_2$ refrigeration circuit.

In accordance with an embodiment of the present invention the method further includes the step of monitoring the condition of the flash gas, i.e. whether the flash gas is superheated or in a 2-phase condition including liquid and gaseous refrigerant, and adjusting the flash gas flow in heat exchanger relationship based on the flash gas condition. It is particularly preferred to have purely gaseous flash gas present at the inlet of the low temperature compressor in order to secure safe operation of the compressor. If the amount of superheating advances towards zero superheating, it is advisable to reduce the flow of flash gas thus increasing the heat transfer.

In accordance with an embodiment of the present invention the step of monitoring the flash gas condition includes the steps of sensing the pressure and the temperature of the flash gas.

In accordance with an embodiment of the present invention the step of monitoring the condition of the flash gas is performed subsequent to the step of flowing the flash gas and the liquid in heat exchange relationship. This allows for a particularly simple monitoring of the flash gas "quality", i.e. the fully dry condition thereof by simply sensing the pressure and temperature thereof. It is also possible to monitor the flash gas condition in the receiver and/or the flash gas line, and to calculate the superheating thereof based on the flows of liquid and gaseous refrigerants in heat exchanger relationship and the amount of heat transfer, etc.

Embodiments of the present invention are described in greater detail below with reference to the Figures, wherein the only FIG. 1 shows a refrigeration circuit in accordance with an embodiment of the present invention.

FIG. 1 shows a $CO_2$ refrigeration circuit 2 for circulating a $CO_2$ refrigerant in a predetermined flow direction. The refrigeration circuit 2 comprises a heat-rejecting heat exchanger 4 which is with a $CO_2$ refrigerant a gascooler in the supercritical operational mode and a condensor in the subcritical mode. A heat exchanger outlet line 6 connects the heat-rejecting heat exchanger 4 via an intermediate expansion device 8 to a receiver 10. While the pressure of the refrigerant can be up to 120 bar and is typically approximately 85 bar in "summer mode" and approximately 45 bar in "winter mode" in the heat-rejecting heat exchanger 10 and its outlet line 6, the intermediate expansion device 8 reduces the pressure to between 30 and 40 bar and preferably 36 bar with such intermediate pressure being typically independent from "winter mode" and "summer mode". The receiver 10 collects and separates liquid and gaseous refrigerant in a liquid and a gaseous receiver portion 12 and 14, respectively.

A liquid line 16 connects the liquid portion 12 of the receiver 10 with the refrigeration consumers 18 and 22 of the medium temperature loop 20 and the low temperature loop 24. Particularly, the liquid line 16 bifurcates into a low temperature branch line 17 and a medium temperature branch line 19. The low and medium temperature loops 20 and 24 each comprise at least one low temperature and medium temperature, respectively, refrigeration consumer 18, 22. The refrigeration consumers 18 and 22 each comprise an expansion device 26, 28 and an evaporator 30, 32.

The medium temperature loop 20 closes through the suction line 34 leading to inlets of compressors 38 of a compressor set 36 of the medium temperature loop 20 and a high-pressure line 40 which connects the outlet of the compressors 38 with the inlet of the heat-rejecting heat exchanger 4. The pressure at the inlet of the medium temperature loop compressors 38 is typically between 20 and 30 bar and approximately 26 bar which results in a temperature of the refrigerant of approximately −10° C. in the refrigeration consumer(s) of the medium temperature loop 20.

In the low temperature loop 24 the low temperature suction line 42 connects the low temperature refrigeration consumer(s) 22 with the inlets of compressors 46 of the low temperature loop compressor set 44. A return line 48 returns the low temperature loop refrigerant to the inlet of the medium temperature loop compressor set 36. While the pressure at the inlet of the low temperature loop compressor set 44 is typically between 8 and 20 bar, and preferably approximately 12 bar which results in a temperature of the refrigerant of approximately −37° C. in the refrigeration consumer(s) of the low temperature loop 24, the pressure at the outlet thereof is approximately at about the same level as the inlet pressure of the medium temperature loop compressor set. The low temperature loop 24 subsequently closes through the common loop portion with the medium temperature loop 20, i.e. medium temperature loop compressor set 36, high-pressure line 40, heat-rejecting heat exchanger 4, intermediate expansion device 8, receiver 10 and liquid line 16.

A flash gas line 50 is connected with the gaseous portion 14 of the receiver 10. The flash gas line 50 taps flash gas which is substantially the saturation pressure, i.e. at least near the 2-phase state thereof. The flash gas line 50 leads the flash gas via a flash gas expansion device, for example a flash gas valve 52, and an internal heat exchanger 54 which is connected to the liquid line 16 in heat exchange relationship with liquid refrigerant and returns it to the inlet or suction of the low temperature loop compressor set 44. Accordingly, the flash gas which is at the intermediate pressure of approximately 36 bar in the receiver is expanded to approximately 12 bar at the inlet to the low temperature loop compressor 46. The respective cooling capacity, i.e. heat from the liquid refrigerant, will substantially be transferred to the liquid refrigerant in the internal heat exchanger 54 and increases the cooling or refrigeration capacity thereof. This transfer of heat to the flash gas refrigerant increases the temperature thereof and insures that the initially 2-phase state flash gas is fully dry and superheated before feeding into the low temperature compressor suction or inlet. The internal heat exchanger 54 can be in the liquid line 16 resulting in an increase of the refrigeration capacity of the liquid for the medium temperature and the low temperature loops 20 and 24, but can also be in any of the branch lines 17 and 19 so that the refrigeration capacity merely for this loop 20 or 24 will be increased. It is also possible to provide a switch-over valve (not shown) in the flash gas line 50 subsequent to the internal heat exchanger 54, and an alternative flash gas line (not shown) which connects the switch-over valve and thus the internal heat exchanger 54 to the inlet or suction of the medium temperature compressor set 36. By switching over between flowing the flash gas to the inlet of the low temperature compressor 46 and the inlet of the medium temperature compressor 38 the increase of the refrigeration capacity can be controlled in a wide range.

The flash gas valve 52 can be thermal expansion device and can be a controllable valve of the type as known to the skilled person. It can particularly be an electronically controlled valve or a mechanically controlled valve. It can be a thermal expansion valve TXV or an electronic expansion valve EXV.

A control 60 is provided for controlling the flash gas valve 52. The control can be separate or part of the overall refrigeration circuit control. The control can also be integrated with the flash gas valve 52. A monitoring device 56 which includes a temperature sensor 70 and a pressure sensor 72 is connected via line 58 to the control 60. The control 60 is adapted to control the flow of flash gas through the internal heat exchanger 54, for example dependent on the desired refrigeration capacity increase in the liquid refrigerant or dependent of the superheat condition of the flash gas. The control 60 can also be adapted to control the above mentioned switch-over valve.

Further sub-cooling is provided for the high-pressure refrigerant in the heat-rejecting heat exchanger outlet line 6. Therefore, a portion of the refrigerant is diverted through high-pressure expansion valve 64 and high-pressure heat exchanger 62 for sub-cooling the remainder of the refrigerant. Line 68 returns the diverted portion of the refrigerant to the inlet of the compressor 66. The inlet of compressor 66 can be at the same pressure level as the remaining compressors 38 of the compressor set 36 or at a different, i.e. higher or lower, level.

The invention claimed is:

1. $CO_2$ refrigeration circuit (2) for circulating a refrigerant in a predetermined flow direction, comprising in flow direction a heat-rejecting heat exchanger (4), a receiver (10) having a liquid portion (12) and a flash gas portion (14), and subsequent to the receiver (10) a medium temperature loop (20) and a low temperature loop (24), wherein the medium and low temperature loops (20, 24) each comprise in flow direction an expansion device (26, 28), an evaporator (30, 32) and a compressor (46, 38), the refrigeration circuit (2) further comprising a liquid line (16) connecting the liquid portion (12) of the receiver (10) with at least one of the medium and low temperature loops (20, 24) and having an internal heat exchanger (54), and a flash gas line (50) connecting the flash gas portion (14) of the receiver (10) via the internal heat exchanger (54) with the inlet of the low temperature compressor (46), wherein the internal heat exchanger (54) transfers in use heat from the liquid flowing through the liquid line (16) to the flash gas flowing through the flash gas line (50).

2. $CO_2$ refrigeration circuit (2) according to claim 1 further comprising a flash gas valve (52) within the flash gas line (50).

3. $CO_2$ refrigeration circuit (2) according to claim 2, wherein the flash gas valve (52) is a control valve.

4. $CO_2$ refrigeration circuit (2) according to claim 1, further comprising a monitoring device (56) in the flash gas line (50) which is adapted for monitoring the condition of the flash gas.

5. $CO_2$ refrigeration circuit (2) according to claim 4, wherein the monitoring device (56) includes a pressure sensor (72) and a temperature sensor (70).

6. $CO_2$ refrigeration circuit (2) according to claim 4, further comprising a control (60) connected to the monitoring device (56) and the control valve (52) for regulating the control valve (52) based on the condition of the flash gas.

7. $CO_2$ refrigeration circuit (2) according to claim 1, further comprising an intermediate expansion device (8) between the heat-rejecting heat exchanger (4) and the receiver (10).

8. $CO_2$ refrigeration circuit (2) according to claim 1, wherein the outlet of the low temperature compressor (46) is connected with the inlet of the medium temperature compressor (38).

9. $CO_2$ refrigeration apparatus (3) comprising a $CO_2$ refrigeration circuit (2) in accordance with claim 1.

10. Method for operating a $CO_2$ refrigeration circuit (2) for circulating a refrigerant in a predetermined flow direction, the $CO_2$ refrigeration circuit (2) comprising in flow direction a heat-rejecting heat exchanger (4), a receiver (10) having a liquid portion (12) and a flash gas portion (14), and subsequent to the receiver (10) a medium temperature loop (20) and a low temperature loop (24), wherein the medium and low temperature loops (24) each comprise in flow direction an expansion device (26, 28), an evaporator (30, 32) and a compressor (46, 38), the refrigeration circuit (2) further comprising a liquid line (16) connecting the liquid portion (12) of the receiver (10) with at least one of the medium and low temperature loops (20, 24), wherein the method comprises the following steps:

(a) tapping flash gas from the flash gas portion (14) of the receiver (10);

(b) flowing the flash gas and flowing the liquid in the liquid line (16) in heat exchange relationship to effect a heat transfer from the liquid to the flash gas;

(c) returning the flash gas into the low temperature loop (24) at a location near the inlet of the low temperature compressor (46).

11. Method according to claim 10, further including the step of adjusting the amount of flash gas which is tapped from the receiver (10) in accordance with the operational condition.

12. Method according to claim 10, further including the step of monitoring the condition of the flash gas and adjusting the amount of flash gas based on the flash gas condition.

13. Method according to claim 12, wherein the step of monitoring the flash gas condition includes the steps of sensing the pressure and the temperature of the flash gas.

14. Method according to claim 12, wherein the step of monitoring the condition of the flash gas is performed subsequent to the step of flowing the flash gas and the liquid in heat exchange relationship.

* * * * *